US005205434A

United States Patent [19]

Brunson et al.

[11] Patent Number: 5,205,434

[45] Date of Patent: Apr. 27, 1993

[54] FOOTED CONTAINER

[75] Inventors: David A. Brunson, Marietta; David A. Deemer; Stephen R. Lynn, both of Douglasville, all of Ga.

[73] Assignee: Constar Plastics, Inc., Atlanta, Ga.

[21] Appl. No.: 896,136

[22] Filed: Jun. 9, 1992

[51] Int. Cl.[5] ..... B65D 1/42

[52] U.S. Cl. ..... 220/608; 215/1 C; 220/606

[58] Field of Search ..... 215/1 C; 220/604, 606, 220/608, 609, 628, 635; 428/35.7, 36.92

[56] References Cited

U.S. PATENT DOCUMENTS 3,598,270 10/1971 Adomaitis et al. .
3,722,726 3/1973 Carmichael et al. .
3,881,621 6/1975 Adomaitis .
4,108,324 8/1978 Krishnakumar et al. .
4,247,012 1/1981 Alberghini .
4,249,666 2/1981 Hubert et al. .
4,294,366 10/1981 Chang .
4,368,825 1/1983 Motill .
4,598,831 7/1986 Nakamura et al. ..... 220/606
4,785,950 11/1988 Miller et al. ..... 220/606
4,865,206 9/1989 Behm et al. .
4,867,323 9/1989 Powers .
4,892,205 1/1990 Powers et al. ..... 215/1 C
4,927,679 5/1990 Beck ..... 428/36.92
4,978,015 12/1990 Walker .
5,024,339 6/1991 Riemer ..... 220/606
5,024,340 6/1991 Alberghini et al. .
5,064,080 11/1991 Young et al. ..... 215/1 C
5,133,468 7/1992 Brunson et al. ..... 215/1 C
5,139,162 8/1992 Young et al. ..... 215/1 C

*Primary Examiner*—Allan N. Shoap
*Assistant Examiner*—S. Castellano
*Attorney, Agent, or Firm*—Locke Reynolds

[57] ABSTRACT

A blow-molded container of thermoplastic resin has a hollow body with a generally cylindrical side wall portion rotationally symmetric about a longitudinal axis of the container. A shoulder portion integrally joins the side wall portion to a finish. An integral base merging with the side wall portion is defined by an outer surface comprising a plurality of downward projections separated from each other by generally arcuate segments extending essentially from the cylindrical side wall to the longitudinal axis of the container. The bottom of the container includes a web extending between a central portion adjacent the longitudinal axis of the container and a generally perpendicular ring segment in each of the downward projections for providing enhanced stability against deflection during entry of the filling liquid into the container which aids in the prevention of bottom failure from stress cracking associated with the rigors of the filling procedure.

20 Claims, 2 Drawing Sheets

FOOTED CONTAINER

BACKGROUND OF THE INVENTION

The present invention relates generally to the design, manufacture and use of blow molded bottles made of polyesters, such as polyethylene terephthalate, and similar containers including footed bottoms having improved dimensional stability suitable for the filling and storage of carbonated beverages.

Various attempts have been made to construct a one-piece, self-supporting plastic container made of polyesters, such as polyethylene terephthalate, which will be able to be filled with and retain carbonated beverages at the pressures typically involved. Such a one-piece container requires the design of a base structure which will support the bottle in an upright position and will not bulge outwardly at the bottom. A variety of designs have been attempted following one of two principal lines of thought. One line of designs involves a so-called champagne base having a complete annular peripheral seating ring. Examples of such bottles are found in U.S. Pat. Nos. 3,722,726; 3,881,621; 4,108,324; 4,247,012; and, 4,249,666. Another variety of designs is that which includes a plurality of feet protruding downward from a curved bottom. Examples of this variety are to be found in U.S. Pat. Nos. 3,598,270; 4,294,366; 4,368,825; 4,865,206; and, 4,867,323.

Bottles using each of these general designs have, in the past, shown significant drawbacks. In order to prevent involution of the bottom of bottles using a champagne style, it was generally found necessary to incorporate a significant amount of resin in the base of the bottle thereby ensuring its stability at room temperature. This incorporation of significant amounts of resin in the base of the bottle had the effect of not only increasing the cost of the bottle, but also making it increasingly subject to drop impact failure.

Reasonably stable footed bottles could be made employing less resin, but the uneven orientation of the polymer in the footed area of the bottom often contributed to uneven post filling expansion of either one or more feet or the central portion of the bottom creating what is generally referred to as a "rocker." Further, it was recognized that the stability of the bottle was directly related to the size of the footprint of the bottle. Whereas some of the earlier designs were in the form of a plurality of nearly point-like feet spaced apart by about half the diameter of the bottle, more recent designs have tended toward a wider spacing of the feet with each foot designed tc contact an increased area of the underlying surface. Examples of such containers are to be found in U.S. Pat. Nos. 4,865,206; 4,978,015; and 5,024,340, as well as PCT publication WO 86/05462.

Throughout the development of various improvements on the two basic designs has been the constant goal to develop a container of stable configuration using as little resin as possible thereby reducing the cost of the container while maximizing the utility of natural resources. Accordingly, it is proposed to construct a container suitable for cold filling and storage of carbonated beverages which utilizes some of the design criteria previously employed in connection with such one piece containers having large standing ring diameters, but which will overcome the observed problems associated with such containers.

One problem with containers of this type is that they are subject to occasional bottom failure believed to be caused by stress cracking associated with the high inlet pressure of the liquid with which the container is filled. The dissipation of the energy on the container bottom leads to the occurence of stress fractures permitting the migration of foreign matter which, after a period of time, can contribute to or result in subsequent bottom failure. Accordingly, a container bottom feature is needed to prevent the aforementioned phenomena from occurring which is strong and flexible enough to withstand and absorb the kinetic energy of the entering liquid when the container is filled.

SUMMARY OF THE INVENTION

In accordance with the present invention, a polyester container having a flexible, right cylindrical body portion symmetric about a vertical axis includes an upper end including a shoulder and mouth of generally conventional design, and a lower end including a large standing ring diameter. The base is defined by an outer surface comprising a plurality of downward projections which are separated from each other by arcuate segments extending from the cylindrical side wall to the longitudinal axis of the container.

Each of the downward projections has, in cross section, a first inclined portion contiguous to the longitudinal axis. A second inclined portion is situated radially outside of, and axially displaced downwardly from the first inclined portion. A nearly perpendicular ring segment has an upper edge united with the first inclined portion with a lower edge united with the second inclined portion. The lower most extent of each downward projection is defined by a radially outwardly and upwardly curved portion having an inner edge united with the second inclined portion and an outer edge leading to the cylindrical side wall.

The stability of the bottom is provided in part by the base having a thickened resin portion extending at least from the inner margin of the first inclined portion to the lower edge of the generally perpendicular ring segment united with the second inclined portion. This thickened portion has a thickness of between about two to eight times the thickness of the side wall of the container. The thickness of the resin is also generally uniformly tapered from a point contiguous to the longitudinal axis of the container along each of the hemispherical segments to the cylindrical side wall.

The resistance of the bottom to stress cracking is also provided in part by providing the base with a smoothly curved portion between the outer margin of the first inclined portion and the upper edge of the nearly perpendicular ring segment. The radius of this upper curved portion is preferably between about 2.00 mm. and about 3.80 mm. Another smoothly curved portion is provided between the inner margin of the second inclined portion and the lower edge of the nearly perpendicular ring. The radius of this lower curved portion is preferably somewhat smaller than the first, having a radius of between about 2.30 mm. and about 3.55 mm.

Each of the downward projections also includes a radial web extending between the first inclined portion and the generally perpendicular ring segment for providing enhanced stability against deflection of the generally perpendicular ring segment during entry of the filling liquid into the container which aids in the prevention of bottom failure from stress cracking associated with the rigors of the filling procedure. The width of the web is preferably about one third the angular width of the second inclined portion. The radial web can include a radial channel extending outwardly and downwardly from adjacent the axis of the bottle to the second inclined portion so that the energy of the incoming liquid may be evenly dissipated over a larger bottom surface area. The pair of inclined portions which are coupled together by the nearly perpendicular ring segment and web provides significant dimensional stability for the base. The wide stance and large arcuate proportion of each of the downward projections provides for significant mechanical stability for the container as a whole against tipping or toppling.

One feature of such a polyester container incorporating a web reinforced segment for the downward projections is a reduced overall weight of the container as compared to comparably sized containers using prior designs. This feature provides the container with an advantage of using less resin and therefore permitting the production of containers at lower cost. The container exhibits improved handling stability over that observed for so called champagne base containers due to its larger standing ring diameter. The container also exhibits exceptional resistance to stress cracking due to the combination of structural features in the base.

These and other features of the present invention, together with their inherent advantages, will become apparent to those skilled in the art upon consideration of the following detailed description of preferred embodiments exemplifying the best mode of carrying out the invention as presently perceived. The detailed description particularly refers to the accompanying drawings.

DESCRIPTION OF THE PREFERRED EMBODIMENTS

Figure 1:
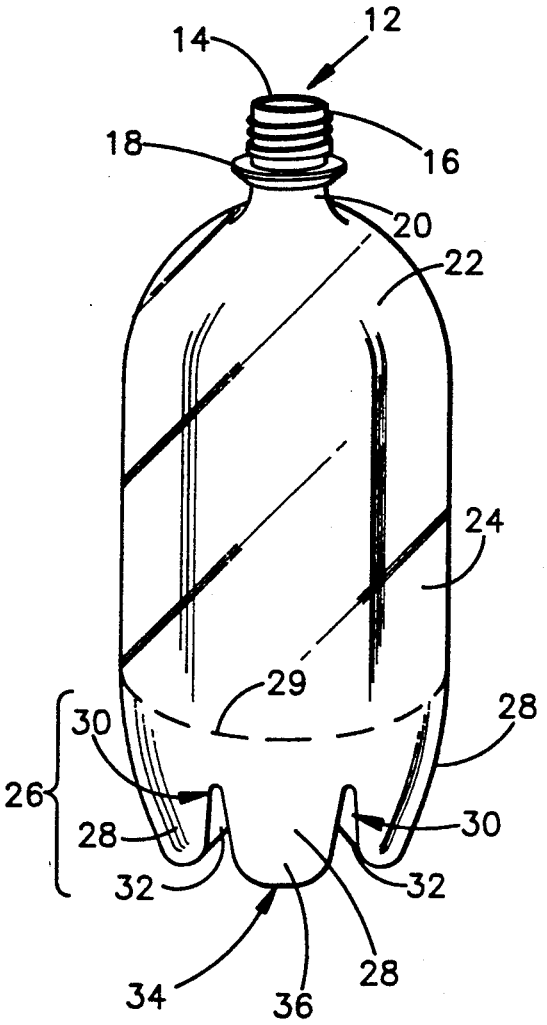
FIG. 1 is a perspective view of a container constructed in accordance with the present invention.

A perspective view of a container 10 made in accordance with the present invention and shown in FIG. 1. includes a mouth 12 defined by a rim 14 at the top of a finish 16 adapted, in the conventional manner, to receive a closure (not illustrated) for sealing the contents of the container. A support ring 18 below the finish 16 is employed during the blow-molding procedure in the usual manner. Immediately below the support ring 18 is a neck 20 which flares outwardly via shoulder portion 22 to a generally cylindrical body portion 24. The container terminates at its lower end in a base 26 which is integrally formed with the cylindrical side wall 24. While the container 10 is shown in FIG. 1 to have a mouth 14 which is only a small fraction of the diameter of the cylindrical side wall 24, the size and appearance of that portion of the container above the cylindrical side wall plays no unique part in the present invention and is merely for illustrative purposes so as to show a preferred container 10.

The base 26 includes a plurality of arcuately extending downward projections 28 which are separated from each other by hemispherical arc segments 30. The hemispherical arc segments 30 are located at the intersection of the S-shaped facets 32 which define the sides of each of the downward projections 28. The uppermost ends of the hemispherical arc segments 30 define a circle 29 lying in a plane normal to the axis Y, shown in FIG. 1, the circle being viewed as the union between the base 26 and the cylindrical side wall 24. The lower most extremities of each of the downward projections 28 is an arcuate line segment 34 located on a radially outwardly and upwardly curved outer surface 36.

Figure 2:
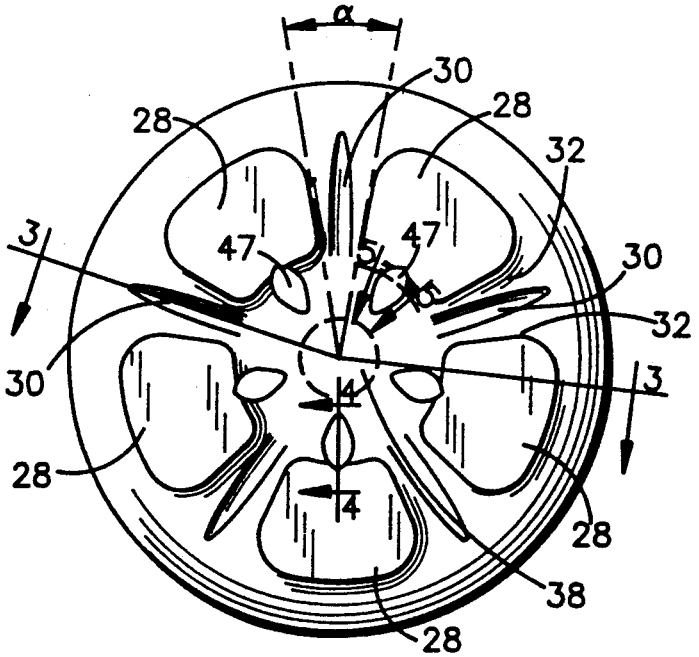
FIG. 2 is a bottom plan view of the container shown in FIG. 1.

A plan view of the bottom as shown in FIG. 2 reveals a central portion 38 surrounded by four arcuately extending downward projections 28 which are in turn separated from each other by four hemispherical segments 30. The S-shaped facets 32 define the sides of each of the arcuately extending downward projections 28 and merge with the hemispherical segments 30. The hemispherical segments and adjoining S-shaped facets 32 occupy an angle $\alpha$ which is shown to be about 20°. The arcuate extent of the downward projections 28 is then about 70° in the embodiment shown in FIGS. 1 and 2. While only four downward projections 28 are shown in FIGS. 1 and 2, a container in accordance with the present invention can have three or more such downward projections. It will be appreciated that as the number of downward projections varies, the arcuate extent of the downward porjections 28 and the separation angle $\alpha$ will also vary. A plurality of webs 47 radially extend outward from the central portion 38 in each of the downward projections 28, and each of the webs 47 occupy approximately five degrees of the arcuate extent of each of the downward projections 28.

Figure 3:
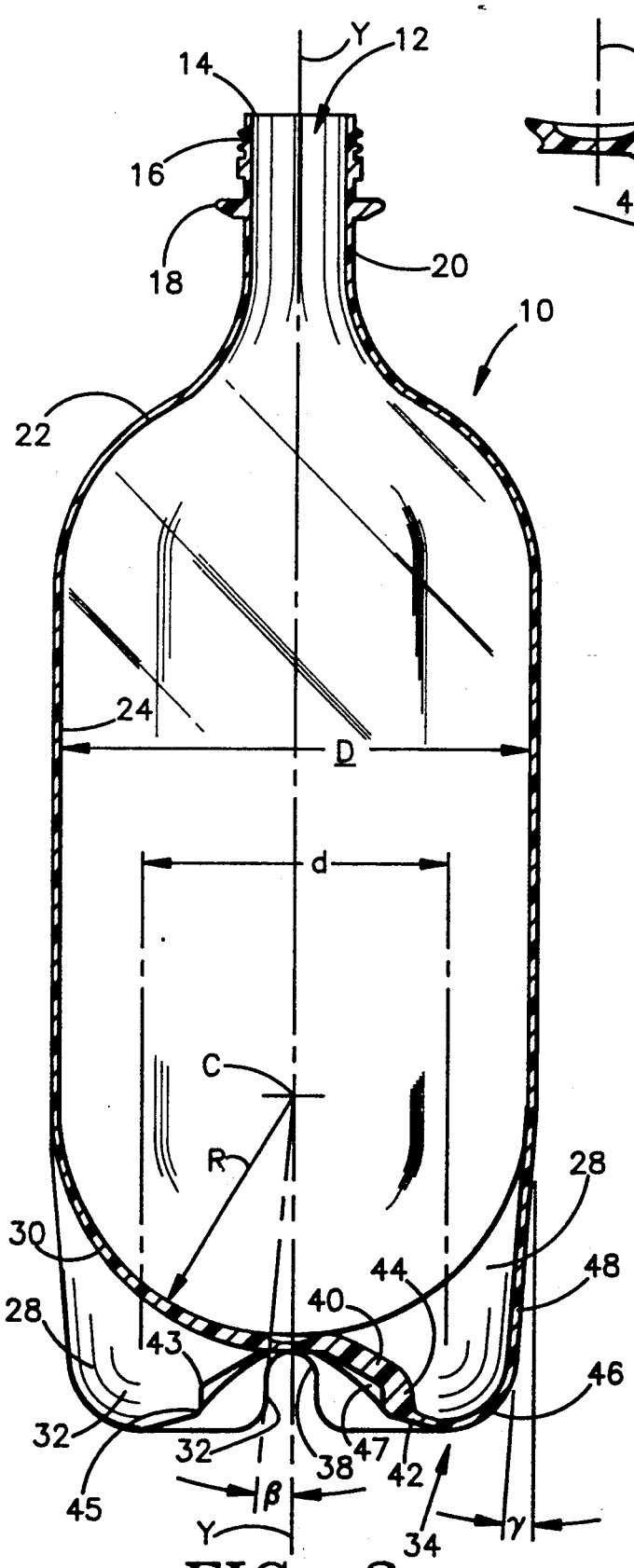
FIG. 3 is a sectional view taken along lines 3—3 of FIG. 2.

In the sectional view shown in FIG. 3, it will be seen that the cylindrical side wall 24 is generally symmetric about a longitudinal axis Y of the container 10. The hemispherical segment 30 can be seen to be the result of a constant radius R established from a center of curvature C located on the longitudinal axis Y. The segment 30 need not be exactly hemispherical and can also be ellipsoidal or other slightly varying radius R. Each of the downward projections 28 includes a first inclined portion 40 and a second inclined portion 42 joined together by a substantially vertical ring segment 44. The inner margin of the first inclined portion merges with the central portion 38 adjacent to the longitudinal axis Y. The first inclined portion 40 is shown to be radially inside and axially upwardly offset from the second inclined surface 42 by virtue of the generally perpendicular ring segment 44.

A small radius curved portion 43 is located between the outer margin of the first inclined portion 40 and the upper edge of the generally perpendicular ring segment 44. The radius of curved portion 43 is preferably between about 2.00 mm. and about 3.80 mm. In a preferred embodiment of a container according to the invention having a volume of about 2 liters, the upper curved portion 43 has a radius of between about 3.05 mm. and 3.40 mm., preferably about 3.25 mm. A second small radius curved portion 45 is located between the inner margin of the second inclined portion 42 and the lower edge of the generally perpendicular ring segment 44. The radius of this lower curved portion 45 is generally somewhat smaller than the first, and is preferably between about 2.30 mm. and about 3.55 mm. In a preferred embodiment of a container according to the invention having a volume of about 2 liters, the lower curved portion 45 has a radius of between about 2.80 mm. and 3.05 mm., preferably about 2.90 mm.

The outer margin of the second inclined portion merges with a radially outward and upwardly curved portion 46 which defines the axially lower most extent of each of the downward projections 28 forming a generally circular but segmented ring 34 defining the foot print on which the container stands. An outer wall portion 48 which is inclined at an angle $\gamma$ with respect to the cylindrical side wall 24 joins the cylindrical side wall to the curved portion 46. As shown in FIG. 3, the angle $\gamma$ is between about 1° and 10°, and preferably about 5° thereby permitting the ring 34 to have a diameter d which is approximately 0.7 times the major diameter D of the cylindrical side wall 24. The center portions of the S-shaped facets 32 which define the sides of the downward projections 28 are shown to be inclined at an angle $\beta$ with respect to a plane passing through the axis of symmetry Y. As shown in FIG. 3, the angle $\beta$ is about 10°.

Figure 4:
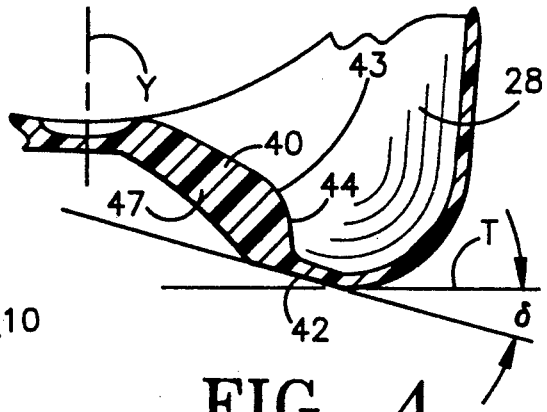
FIG. 4 is a sectional view taken along lines 4—4 of FIG. 2.

FIG. 4 is an enlarged view of one of the downward projections 28 sectioned through a web 47 along line 4—4 of FIG. 2. The said second inclined portion 42 of the downward projection 28 is inclined at an angle $\delta$ of about 10° with respect to a plane T normal to the longitudinal axis Y of the bottle 10. The web 47 is shown to tie portions 40 and 44 together thereby reducing the liklihood of the development of stress cracks in the area of upper curve 43. The inlet pressure of the fluid with which the bottle is filled is typically between about 20 and 70 nt/cm$^2$. The bottom of the container must therefore be capable of absorbing the kinetic energy of the filling liquid when the container is filled. To preclude bottom failure from stress cracking webs 47 serve to provide enhanced stability against deflection of portion 44 during entry of the filling liquid into the container.

Figure 5:
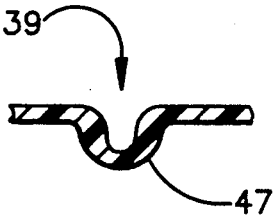
FIG. 5 is a sectional view taken along lines 5—5 of FIG. 2.

FIG. 5 is a sectional view of an alternative embodiment of the invention in which the web 47 contains a channel 39 radially extending from said first inclined portion through said perpendicular ring segment to said second inclined portion for dispersing the filling liquid from the axis toward the downward projections to dissipate the kinetic energy of the incoming filling liquid over a larger area. A portion of the filling liquid, upon entering mouth 12 of the container 10 and impacting on the bottom of the container, is sidewardly deflected from the central portion 38 relative to longitudinal axis Y along inclined portions 40 and 42 and the ring segment 44 while the remaining portion of the filling liquid travels at a greater angle relative to the axis Y down the channels 39 within webs 47. These two portions merge together in the lower portion of downward projections 28.

Although the invention has been described in detail with reference to certain preferred embodiments and specific examples, variations and modifications exist within the scope and spirit of the invention as described and as defined in the following claims.

What is claimed is:

1. A blow-molded container of thermoplastic resin adapted to receive a filling liquid, said container having a hollow body with a generally cylindrical side wall portion rotationally symmetric about a longitudinal axis of the container, the container additionally having a finish, a shoulder portion integrally joining an upper end of the side wall portion to the finish, and an integral base merging with a lower end of the side wall portion, said base comprising:

a plurality of generally arcuate segments extending essentially from the cylindrical side wall portion to the longitudinal axis of the container;

a like plurality of downward projections separated from each other by one of said generally arcuate segments, said downward projections including a first inclined portion adjacent to the longitudinal axis, a second inclined portion situated radially outside of, and axially displaced downwardly from, the first inclined portion, a generally perpendicular ring segment having an upper edge united with the first inclined portion and a lower edge united with the second inclined portion, and a radially outwardly and upwardly curved portion uniting the second inclined portion to the side wall portion and defining the axially lower most extent of each downward projection; and a like plurality of webs extending between the first inclined portion and the generally perpendicular ring segment of each of said downward projections for providing enhanced stability against deflection during entry of the filling liquid into the container.

2. The blow-molded container of claim 1 wherein each of said webs includes a channel radially extending from said first inclined portion through said perpendicular ring segment to said second inclined portion for dispersing the filling liquid from the axis toward the downward projections.

3. The blow-molded container of claim 1 wherein each of said downward projections further includes an upper curved portion located at the union of said generally perpendicular ring segment upper edge and said first inclined portion, the upper curved portion having a radius of between about 2.00 mm. and about 3.80 mm.

4. The blow-molded container of claim 3 having a volume of about 2 liters and wherein said upper curved portion has a radius of between about 3.05 mm. and 3.40 mm.

5. The blow-molded container of claim 1 wherein each of said downward projections further includes a lower curved portion located at the union of said generally perpendicular ring segment lower edge and said second inclined portion, the lower curved portion having a radius of between about 2.30 mm. and about 3.55 mm.

6. The blow-molded container of claim 5 having a volume of about 2 liters and wherein said lower curved portion has a radius of between about 2.80 mm. and 3.05 mm.

7. The blow-molded container of claim 1 wherein the base is further defined by a thickened portion extending from the longitudinal axis of the container to the lower edge of the generally perpendicular ring segment united with the second inclined portion, the thickened portion having a thickness of between about two to eight times the thickness of the side wall portion of the container.

8. The blow-molded bottle of claim 1 wherein each of said downward projections further includes S-shaped radial portions joining the second inclined portion to the adjacent arcuate segments.

9. A blow-molded container of thermoplastic resin adapted to receive a filling liquid, said container having a hollow body with a generally cylindrical side wall portion rotationally symmetric about a longitudinal axis of the container, the container additionally having a finish, a shoulder portion integrally joining an upper end of the side wall portion to the finish, and an integral base merging with a lower end of the side wall portion, said base comprising:

a plurality of generally arcuate segments extending essentially from the cylindrical side wall portion to the longitudinal axis of the container;

a like plurality of downward projections separated from each other by one of said generally arcuate segments, said downward projections including a first inclined portion adjacent to the longitudinal axis, a second inclined portion situated radially outside of, and axially displaced downwardly from, the first inclined portion, a generally perpendicular ring segment having an upper edge united with the first inclined portion and a lower edge united with the second inclined portion, an upper curved portion located at the union of the generally perpendicular ring segment upper edge and the first inclined portion, a lower curved portion located at the union of said generally perpendicular ring segment lower edge and said second inclined portion, and a radially outwardly and upwardly curved portion uniting the second inclined portion to the side wall portion and defining the axially lower most extent of each downward projection; and a like plurality of webs extending between the first inclined portion and the generally perpendicular ring segment of each of said downward projections for providing enhanced stability against deflection during entry of the filling liquid into the container.

10. The blow-molded bottle of claim 9 wherein the radius of said upper curved portion located at the union of the generally perpendicular ring segment upper edge and the first inclined portion is greater than the radius of said lower curved portion located at the union of said generally perpendicular ring segment lower edge and said second inclined portion.

11. The blow-molded container of claim 10 wherein each of said upper curved portions have a radius of between about 2.00 mm. and about 3.80 mm.

12. The blow-molded container of claim 11 having a volume of about 2 liters and wherein said upper curved portion has a radius of between about 3.05 mm. and 3.40 mm.

13. The blow-molded container of claim 12 wherein said upper curved portion has a radius of about 3.25 mm.

14. The blow-molded container of claim 10 wherein each of said lower curved portions have a radius of between about 2.30 mm. and about 3.55 mm.

15. The blow-molded container of claim 14 having a volume of about 2 liters and wherein said lower curved portion has a radius of between about 2.80 mm. and 3.05 mm.

16. The blow-molded container of claim 15 wherein said lower curved portion has a radius of about 2.90 mm.

17. The blow-molded container of claim 9 wherein each of said webs includes a channel radially extending from said first inclined portion through said perpendicular ring segment to said second inclined portion for dispersing the filling liquid from the axis toward the downward projections.

18. The blow-molded bottle of claim 9 wherein said second inclined portion of each of said downward projections is inclined at an angle of about 10° with respect to a plane normal to the longitudinal axis of the bottle.

19. A blow-molded container of thermoplastic resin having a hollow body with a generally cylindrical side wall portion rotationally symmetric about a longitudinal axis of the container, the container additionally having a finish, a shoulder portion integrally joining the side wall portion to the finish and an integral base merging with the side wall portion, said base being defined by an outer surface comprising:

a plurality of downward projections separated from each other by generally arcuate segments extending essentially from the cylindrical side wall portion to the longitudinal axis of the container, said downward projections including:

a first inclined portion adjacent to the longitudinal axis of the container;

a second inclined portion situated radially outside of and axially displaced downwardly from said first inclined portion;

a generally perpendicular ring segment having an upper edge united with the first inclined portion and a lower edge united with the second inclined portion;

an upper curved portion located at the union of the generally perpendicular ring segment upper edge and the first inclined portion, the upper curved portion having a radius of between about 2.00 mm. and about 3.80 mm.;

a lower curved portion located at the union of said generally perpendicular ring segment lower edge and said second inclined portion, the lower curved portion having a radius of between about 2.30 mm. and about 3.55 mm.;

a radially outwardly and upwardly curved portion uniting the second inclined portion to the side wall portion and defining the axially lower most extent of each of said downward projections; and a web extending between the first inclined portion and the generally perpendicular ring segment of each of said downward projections for providing enhanced stability against deflection during entry of the filling liquid into the container.

20. The blow-molded container of claim 19 wherein each of said downward projections further includes a channel located in each of said downward projections radially extending from said first inclined portion through said perpendicular ring segment to said second inclined portion.

* * * * *